United States Patent [19]

Lappage et al.

[11] Patent Number: 4,606,181

[45] Date of Patent: Aug. 19, 1986

[54] METHOD AND APPARATUS FOR PRODUCING SPUN YARNS OF VARIOUS CONSTRUCTIONS

[75] Inventors: James Lappage, Southbridge; James Bedford, Christchurch, both of New Zealand

[73] Assignee: Wool Research Organisation of New Zealand (Inc.), Canterbury, New Zealand

[21] Appl. No.: 466,562

[22] Filed: Feb. 15, 1983

[30] Foreign Application Priority Data

Feb. 15, 1982 [NZ] New Zealand ..... 199738

[51] Int. Cl.[4] ..... D02G 3/38; D01H 1/10; D01H 5/28; D01H 7/86

[52] U.S. Cl. ..... 57/58.38; 57/58.3; 57/58.36; 57/58.59; 57/58.86; 57/315; 57/328

[58] Field of Search ..... 57/58.3–58.38, 57/58.39–58.63, 58.83, 58.86, 315, 328

[56] References Cited

U.S. PATENT DOCUMENTS

| | | | |
|---|---|---|---|
| 3,064,413 | 11/1962 | Starnes | 57/58.59 |
| 3,106,055 | 10/1963 | Mackie | 57/58.59 |
| 3,820,316 | 6/1974 | Clarkson | 57/58.3 X |
| 4,034,544 | 7/1977 | Clarkson | 57/58.3 X |
| 4,197,696 | 4/1980 | Bock | 57/58.3 X |
| 4,301,975 | 11/1981 | Camardella | 57/58.3 X |

*Primary Examiner*—John Petrakes

*Attorney, Agent, or Firm*—Watson, Cole, Grindle & Watson

[57] ABSTRACT

A method and apparatus for producing spun yarns of various constructions which includes separating a potentially highly productive drafting stage from a spinning process and thereafter by the use of an apparatus which can be used to spin and ply two yarns while inserting an amount of twist of one sense into each yarn while concurrently plying those yarns with an equal amount of twist of the opposite sense. The apparatus can also be used to spin singles yarns while concurrently inserting twist into that yarn in a two-for-one mode. The yarns can be two twistless staple yarns or a singles yarn which is spun and plied with a two-fold yarn to produce a three-fold yarn structure. The twist in the three singles components of the three-fold yarn structure can be equal in magnitude and sense while the plying twist between the three singles yarns can be equal in magnitude and opposite in sense to the twist in the singles yarns. The method can produce yarns in which the singles and plying twist senses can be twist-on-twist, twist-against-twist, or a combination of these geometries. The raw material supplied to the apparatus can be packages of twistless yarns such as the slubbings produced on a woollen carding machine, or twistless yarns such as those in which fibre cohesion is achieved by means of a weak adhesive or by consolidating the fibres in a rubbing process. The apparatus can be used to perform the function of a conventional two-for-one twisting machine or to combine conventionally spun yarns into various complex structures while simultaneously modifying their individual twists in the initial state.

30 Claims, 4 Drawing Figures

METHOD AND APPARATUS FOR PRODUCING SPUN YARNS OF VARIOUS CONSTRUCTIONS

FIELD OF THE INVENTION

The present invention relates generally to the manufacture of spun yarns, string, cords and other continuous thread-like materials. More particularly, the present invention relates to a modified processing system and apparatus for the production of a wide variety of yarn structures, including singles yarns, plied yarns and cabled yarns.

DESCRIPTION OF THE PRIOR ART

In conventional yarn making practice singles yarns are spun and used as basic building blocks in the manufacture of the more complex yarn structures. Prior to the spinning process, fibres, which can be of natural or synthetic origin, are prepared on a processing line which can include one or more of the steps of carding, gilling, combing, drawing and roving. The prepared material is then creeled in packages in a spinning frame where it is subjected first to a draft, or attenuation, by which the linear density is reduced to a required level, and is then twisted with an amount of twist which depends upon the weight of the yarn and its intended use. The spinning operation is thus normally carried out on a machine such as a ringframe, a cap-frame or a flyer-frame, in which the rotation of a spindle serves to both insert twist into the yarn and to wind the yarn onto a package carried on the spindle. Alternatively, the operation can be carried out on an open-end spinning machine on which twist is inserted into the yarn by rotating the forming yarn tail at a discontinuity in the supply of fibres, and in which the yarn is wound onto a package which is rotated solely for the purpose of winding.

In the manufacture of plied yarns, for example, a two-fold yarn, singles yarns are creeled onto a twisting machine such as a ring-twister, there being two singles yarns creeled for each spindle of the twisting machine. The singles yarns are delivered together at a constant speed and are twisted together and wound onto a package by the rotation of the spindle. Alternatively, two singles yarns can be wound together into a single package which is creeled on a ring-twister, or can be used on a two-for-one twisting machine. In the two-for-one twisting machine twist is inserted by continuously looping the yarn around the supply, such that two turns of twist are inserted between the two singles yarns for each revolution of the spindle. The plied yarn so formed is then wound into a package, which is rotated solely for the purpose of winding.

Conventional processing lines have several drawbacks or disadvantages which arise from the methods of processing and the way these are organized in sequence. In the spinning process it has in the past been found advantageous to include a drafting step as part of the spinning function, particularly in those processing routes where high draft ratios can be used. This, however, limits the methods that can be used to insert twist into the yarn, and the twisting action imposes an overall limitation on the productivity of the process. In open-end spinning twist can be inserted into the yarn at considerably higher rates, but open-end spun yarns have been found to suffer from significant deficiencies of structure, such that their use has become limited. Also, in spinning machines of the ring and spindle type the size of the package that can be made is limited by the gauge of the machine and the spindle speed at which it is desired to operate.

In U.S. Pat. Nos. 3,820,316 (Clarkson) and 4,034,544 (Clarkson) are described methods and apparatus for producing continuous filament or spun staple yarns in which the plied yarns are subjected to heat while tension in the yarn is relaxed, after which it is cooled and dried to enable the yarn to be twist set in a bulked condition. The objects of and the teachings of both these patents relate to the manufacture of carpet yarns which optimize the development of bulk and dyeability in plied yarns by twist setting the yarn in the presence of either dry or moist heat under relaxed tension. These patents do not describe or relate to the production of a variety of yarns by modifying a yarn processing system and apparatus to form a wide variety of yarn structures, including singles yarns, plied yarns and cabled yarns.

A further disadvantage of conventional processes lies in the need to provide separate machines of different design for the purpose of producing plied yarns. These machines can be substantially similar to spinning machines but without having means to draft the material supplied to it. The function of the plying machine is thus limited to the manufacture of plied yarns, and those machines of the ring and spindle type are further limited in the method of twist insertion and the size of the package which can be produced. The two-for-one twisting machine is less limited in package size, but by virtue of design its function is limited to that of plying.

Accordingly, it is a primary object of the present invention to provide a method and apparatus for producing a wide variety of yarn structures in a manner which avoids many of the disadvantages of the conventional processes and which provides economies of manufacture.

It is another object of the present invention to provide an apparatus which has the versatility to produce singles, plied or cabled yarns as are from time-to-time required, without the necessity of effecting extensive adjustments to the apparatus.

It is a further object of the present invention to provide a method of processing by which all the advantages of the novel apparatus can be exploited.

SUMMARY OF THE INVENTION

According to one aspect of the present invention, there is provided a method of producing two-fold yarns in one continuous operation which includes separating a potentially highly productive drafting stage from a spinning process, and thereafter, using an apparatus which can be used to spin and ply two twistless staple yarns, inserting an amount of twist of one sense into each singles yarns whilst concurrently plying those yarns with an equal amount of twist of the opposite sense.

According to a second aspect of the present invention, there is provided a method of producing spun yarn which includes separating a potentially highly productive drafting stage from a spinning process, using an apparatus which can be used to spin singles yarns whilst concurrently inserting twist into that yarn in a two-for-one mode.

According to a third aspect of the present invention, there is provided a method of producing spun yarn which includes separating a potentially highly productive drafting stage from a spinning process, using an apparatus which can be used to produce a singles yarn whilst concurrently plying it with a two-fold yarn to produce a three-fold yarn structure. In the third aspect, the twist in the three singles components of the three-fold yarn structure can be equal in magnitude and sense whilst the plying twist between the three singles yarns can be equal in magnitude and opposite in sense to the twist in the singles yarns.

According to a fourth aspect of the present invention, there is provided a method of producing twisted yarn constructions using an apparatus which can be used to combine various existing singles or plied yarn structures to form yarns of higher complexity, such as fresco yarns and cables.

The method can be used to produce plied yarns in which the singles and plying twist senses can be twist-on-twist, twist-against-twist, or any combinations of those geometries.

The apparatus is supplied with raw material comprising packages of twistless yarns such as the slubbings produced on a woollen carding machine, or twistless yarns such as those in which fibre cohesion is achieved by means of a weak adhesive or by consolidating the fibres in a rubbing process.

The apparatus according to the present invention can also be used to perform the function of a conventional two-for-one twisting machine or to combine conventionally spun yarns into various complex structures whilst simultaneously modifying their individual twists in the initial state.

BRIEF DESCRIPTION OF THE DRAWINGS

The invention will be more clearly understood with reference to the examples described with reference to the accompanying drawings, which are given by way of example only, and in which.

DESCRIPTION OF THE PREFERRED EMBODIMENTS

Figure 1:
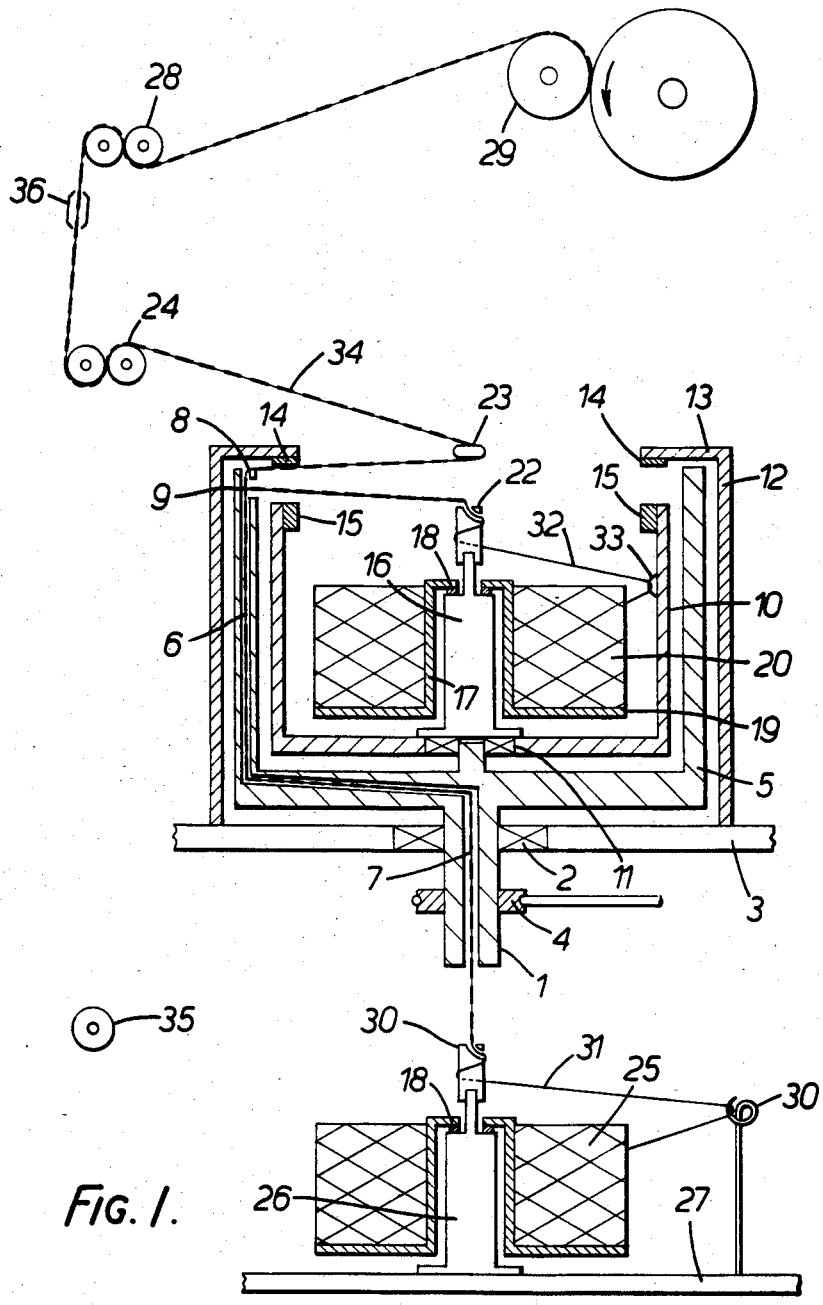
FIG. 1 is a schematic diagram of an apparatus according to a preferred embodiment of the present invention, showing its use for the production of two-fold yarn.

Referring now to FIG. 1, the apparatus according to a preferred embodiment of the invention comprises a hollow spindle 1, supported by a bearing 2 in a rail 3, and has a pulley 4 by which it is driven by a drive motor (not shown). A rotor consisting of a cylinder 5 carried on top of, and which can form an integral part of, spindle 1, is penetrated by a passageway or tube 6 which interconnects with the bore 7 in the spindle 1. The passageway 6 in the cylinder 5 has an egress 8 at the top of the cylinder 5, situated closely to an ingress 9 in the cylinder wall, and which also connect with the passageway 6. On top of the spindle 1 and within the cylinder 5, a second cylinder 10 is supported on a bearing 11, such that cylinder 10 can be stationary whilst the spindle 1 and its associated cylinder 5 are rotating. Cylinder 10 has magnets 15 and a yarn guide 33 fixed close to its upper rim. Cylinder 5 can be surrounded by a third, stationary cylinder 12 which forms a guard around cylinder 5, and is securely attached to the rail 3. On top of cylinder 12 is carried a partial annulus 13, which in turn carries magnets 14, equal in number and of opposite polarity to magnets 15. Reaction between magnets 14 and 15 provides force of sufficient moment to overcome the frictional forces transmitted by the bearing 11 and windage on the surface of cylinder 10 occasioned by the rotation of cylinder 5 and spindle 1. Within the cylinder 10 is a central mandrel which comprises a fixed inner part 16 supporting an outer part 17 which is free to rotate on a low friction bearing 18. A disc 19 is attached to the lower end of the mandrel part 17, together with which it supports a package of twistless yarn 20. Mandrel part 16 has a narrowed portion at the top which supports a capstan 22 having a yarn guide at its top. Capstan 22 is a push fit on mandrel part 16 such that it can be rotated relative to part 16 by firm finger torque. A yarn guide 23 is fixed above the capstan 22 on the common axis of the spindle 1 and mandrel part 16, and a pair of rollers 24 is provided to control the rate at which yarn is delivered. A second package 25 of twistless yarn is located below the hollow spindle 1 and is supported by a mandrel 26 and capstan, of similar design to mandrel 16,17, on a rail 27. A second pair of rollers 28 can be provided so that yarn can be drafted in the zone between rollers 24 and rollers 28. A winding mechanism 29 is provided to package the plied yarn. Whilst being drafted between the rollers 24 and rollers 28, control of the fibres within the yarn is achieved by virtue of the twist within the yarn, in a similar manner to a method of achieving fibre control during drafting in the conventional woollen spinning process. By this means, draft ratios of up to 1.5 to 1 are possible, and in order to optimize the degree of fibre control in the drafting zone, a false twisting mechanism 36 can be included to temporarily modify the twist in the yarn within the drafting zone in a manner similar to that commonly used in the conventional woollen spinning process. In the present case, however, the false twisting mechanism can be used to temporarily remove or reduce the twist in the yarn rather than temporarily increase the twist in the yarn, as is the case in conventional woollen spinning.

In operation, when it is required to produce a two-fold yarn, yarn 31 from the supply package 25 is withdrawn via yarn guide 30 and the capstan on top of mandrel 26, and is then taken through the bore 7 in spindle 1 and the passageway 6 in the rotor 5 to egress at 8. Yarn 32 from the supply 20 is withdrawn via yarn guide 33 and the yarn guide in the capstan 22 to the ingress 9 in the wall of cylinder 5 where it is converged with yarn 31. Withdrawal of yarns 31 and 32 from their respective supply packages 25 and 20 sets up a low tension in the yarns between their respective supply packages and tension control capstans, this tension being just sufficient to pull the supply packages and support mandrels, causing them to rotate on the low friction bearings 18, and so deliver yarn by unwinding. Yarns 31 and 32 are then taken together via rollers 24 and 28 to the yarn winding station 29. It will be appreciated that yarn 31 is ballooned around supply package 20 by virtue of the rotation of the spindle/cylinder 1,5 rotor assembly, thereby generating one turn of real twist between the two yarns 31 and 32 for each revolution of the rotor. It will also be appreciated that, in the absence of yarn 32, the action of the rotor on yarn 31 is simply that of a false twisting mechanism, one turn of twist of one sense being generated in yarn 31 between the hollow spindle and the capstan of mandrel 26, and one turn of twist of the opposite sense being generated in yarn 31 between the egress 8 and the yarn guide 23 for each revolution of the rotor. These twists are thus mutually cancelling, and if the apparatus were to be run with only the supply package 25 of twistless yarn, then the yarn wound at the winding station 29 would also be twistless. Similarly, in the absence of yarn 31, false twist is generated in yarn 32 by virtue of the rotation of the rotor, one turn of twist of one sense being generated between the capstan 22 and yarn ingress 9, and one turn of twist of the opposite sense being generated between the egress 8 and the yarn guide 23 for each revolution of the rotor. A yarn guide 35 is provided below the spindle station for use when spinning singles yarn.

In practice, when yarns 31 and 32 are processed together, real plying twist is generated between them by virtue of yarn 31 being ballooned around the supply package 20. This plying twist is inserted at the yarn guide 23 to form a plied yarn 34 and is carried downstream with the yarn 34 from that point. In practice it has been found that by virtue of the plying torque generated at the yarn guide 23, the plying twist also tends to run against the flow of yarn some way towards the yarn egress 8. From the yarn guide 23 the plied yarn 34 is delivered via the take-off rollers 24 and the drafting rollers 28 to the yarn take-up station 29. If this plied yarn is now examined and the plying twist is removed by untwisting, it will be found that the two singles yarn components both contain twists which are equal in magnitude and sense, and are equal in magnitude but of opposite sense to the plying twist between them. This yarn structure is thus identical with a two-fold yarn of conventional manufacture in which firstly singles yarns are spun having X twists per unit length of Z twist, and two such singles yarn are plied together with X twists per unit length of S twist.

Figure 2:
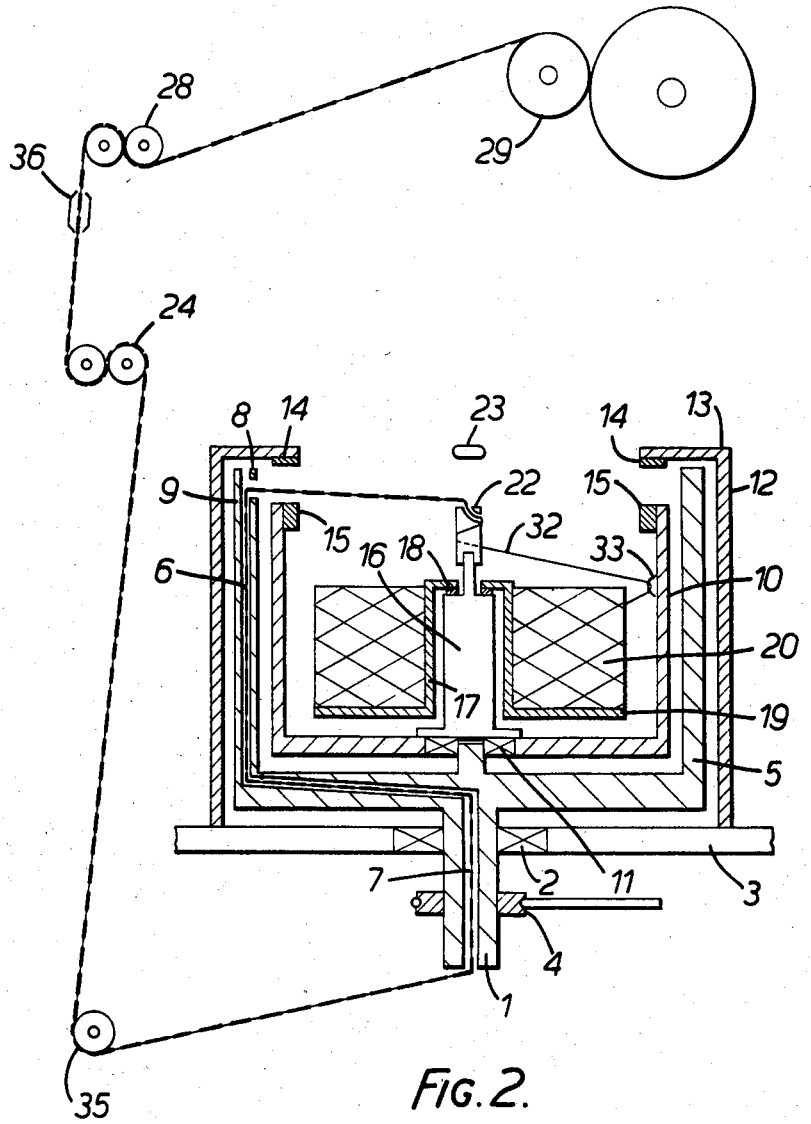
FIG. 2 is a schematic diagram of part of an apparatus according to a preferred embodiment of the invention, showing its use of the production of singles yarns.

Referring now to FIG. 2, when it is desired to produce a singles yarn the lower supply package is not required and only the supply package 20 is creeled into the machine. When spinning singles yarn the flow of yarn through the passageway 6 in the wall of the rotor 5 is reversed so that yarn from supply package 20 is taken via yarn guide 33 and the yarn tensioning capstan 22 to the ingress 9 in the rotor wall, and via the passageway 6 to the bore 7 in spindle 1. From the bottom of spindle 1 the singles yarn is then taken via yarn guide 35 to the take-off rollers 24, the drafting rollers 28 and the yarn take-up station 29. By virtue of the rotation of the rotor, yarn 32 is caused to balloon around its supply package 20 between the top of capstan 22 and the axis of spindle 1. For each revolution of the balloon, one turn of twist is inserted into yarn 32 as it emerges from the capstan 22, and a second turn of twist, of the same sense as the first turn, is inserted into yarn 32 within the hollow spindle. The apparatus is then operating in a two-for-one mode of twist insertion.

Figure 3:
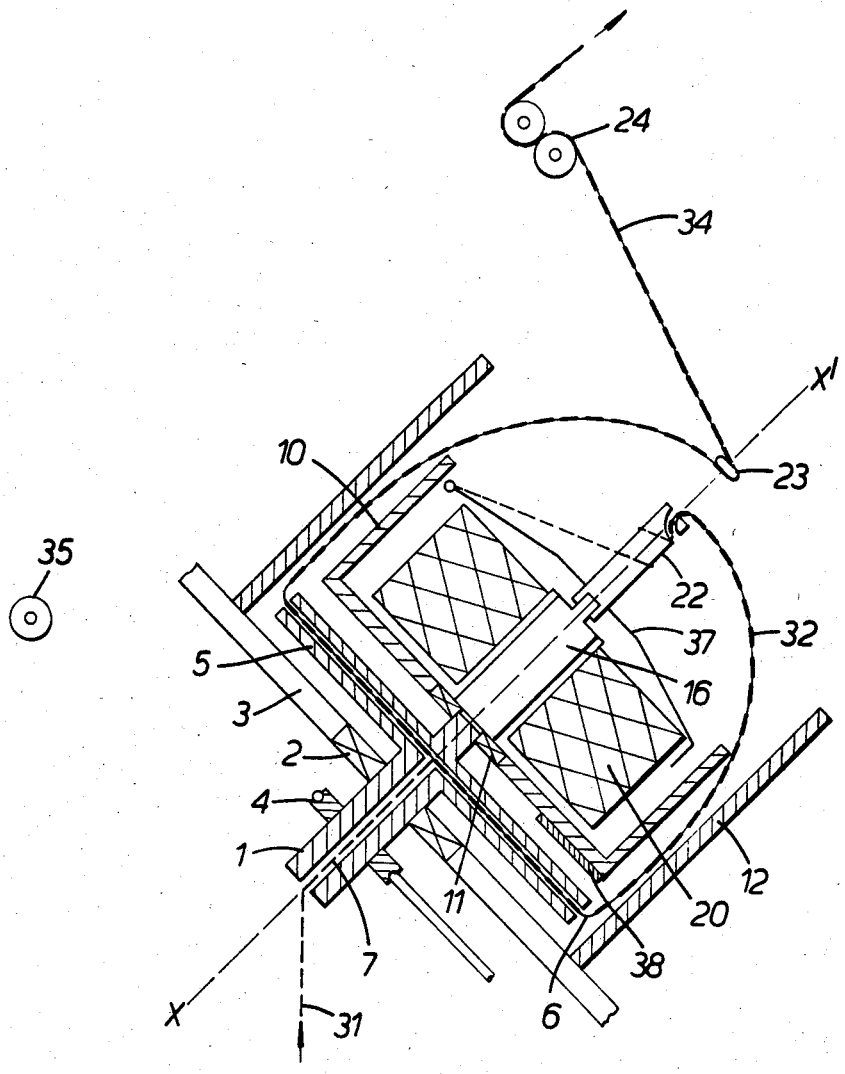
FIG. 3 is a schematic diagram of an alternative spindle design, showing also an alternative method of delivering yarn from the supply package.

An alternative design of apparatus which can be preferred for the production of some yarn types is illustrated schematically in FIG. 3 and comprises a hollow spindle 1 which is supported, for example, in a non-vertical attitude on the axis $XX^1$ by a bearing 2 in a rail 3, and has a pulley 4 by which it is driven by a drive motor (not shown), and a disc 5 carried on top of, and forming an integral part of, spindle 1 is penetrated by a passageway or tube 6 which interconnects with the bore 7 in the spindle 1. On top of the spindle/disc assembly a cylinder 10 is supported by a bearing 11 and such that cylinder 10 can be stationary whilst the spindle/disc assembly is rotating. Within the cylinder 10 is a central mandrel 16 which supports a package of twistless yarn 20. A flyer arm 37, integral with a capstan 22 mounted on top of, and co-axially with, the mandrel 16 is free to rotate about its axis, and assists in delivering yarn from the package 20 and in controlling the yarn tension. A yarn guide 23 is fixed above the capstan 22 on the common axis $XX^1$, and a pair of rollers 24 is provided to control the rate at which yarn is delivered. A counterweight 38 is eccentrically positioned in cylinder 10 so as to deter rotation of cylinder 10 and its contents by virtue of gravitational force.

Alternatively, rotation of cylinder 10 can be deterred by magnetic means. A balloon control ring or shield 12, can be provided surrounding the ballon formation area to provide improved control of the yarn balloon during high-speed spinning. A yarn guide 35 is provided below the spindle station for use when spinning singles yarn. A second yarn supply package (not shown) is provided below the spindle, together with its associated flyer arm and support mandrel, and drafting rollers and a yarn-take-up station can be provided as previously described and illustrated in FIG. 1.

In operation, and when producing singles yarn, the lower supply package is not required, and yarn 32 from package 20 is taken through the balloon zone to an inlet to the passageway 6 in the disc/spindle assembly 5,1. Yarn 32 is then withdrawn down through the hollow spindle 1 and is delivered via guide 35 to the drafting zone and the yarn winding station. By virtue of the rotation of the spindle/disc assembly 1,5, yarn 32 is caused to balloon around its supply package 20 between the guide on top of the capstan 22 and the ingress to the disc 5. For each revolution of the balloon one turn of twist is inserted into the yarn as it emerges from the capstan 22, and a second turn is inserted into the yarn 32 within the hollow spindle. In FIG. 3 the apparatus is shown producing two-fold yarn in which case the second yarn supply package is required. Yarn 32 from the supply package 20 is taken first through the balloon zone between the top of capstan 22 and the ingress to the passageway to the disc 5, through the disc and then through a second balloon stage between the egress from the disc 5 and the yarn guide 23. Yarn 31 from the second supply is taken through the hollow spindle to join with yarn 32 within the passageway 6 in the disc 5. On emerging from the disc 5 in company with yarn 32, the yarn 31 is also ballooned between the egress from disc 5 and the yarn guide 23, to form a common balloon with yarn 32. By virtue of the rotation of the spindle/-disc assembly 1,5 yarn 32 is then ballooned twice around its own supply package 20; and under this circumstance for every revolution of the spindle/disc 1,5 assembly, one turn of twist of one sense is inserted into yarn 32 as it emerges from the top of capstan 22, and a second turn of twist of the opposite sense is inserted into yarn 32 as it passes through the yarn guide 23. These twists are thus mutually cancelling, and if yarn 32 were to be processed in this way in the absence of any other yarn, then the spindle would be acting as a false-twisting device and downstream of the yarn guide 23 the twist in yarn 32 would be unchanged from its initial condition. Also, by virtue of the rotation of the spindle/disc 1,5 assembly, one turn of twist of one sense is inserted into yarn 31 along the axis of rotation and within the bore 7 of spindle 1, and a second turn of twist of the opposite sense is inserted into yarn 31 at the yarn guide 23. These twists are again mutually cancelling, and if yarn 31 were to be thus processed in the absence of any other yarn, then the spindle would again be acting as a false twist device, and downstream of yarn guide 23 the twist in yarn 31 would be unchanged from its initial condition.

In practice, when yarns 32 and 31 are processed together, a real plying twist is generated between them by virtue of yarn 31 being ballooned around the supply package 20. This ply twist is inserted between the two yarns at the yarn guide 23 to form a plied yarn 28 and is carried with the yarn 28 downstream from that point. In practice, it has been found that by virtue of the plying torque generated at the yarn guide 23, the plying twist also tends to run against the flow of yarn some way into the balloon zone. From the yarn guide 23 the plied yarn 28 can be delivered via the take-off rollers 24 to a drafting zone and a yarn take-up station as previously described and illustrated in FIG. 1.

The spinning action of this alternative design of spindle is substantially the same as that previously described in relation to FIG. 1, in that when a singles yarn is produced the yarn 32 is caused to balloon continuously around its own supply package 20, two turns of twist being inserted into yarn 32 for each rotation of the spindle/disc assembly, and when a two-fold yarn is produced the yarn 31 is continuously ballooned around the yarn supply package 20 such that real twist is generated between the singles yarns 32 and 31. Again, when spinning two-fold yarns, false twist is generated in each of the singles yarns 32 and 31 between the point of delivery from their respective capstan tension controls and the yarn guide 23. Again, when producing two-fold yarn the plying twist is generated at the yarn guide 23 and is carried downstream with the yarn but also tends to run upstream towards the point at which the two singles yarns 32 and 31 are first converged, by virtue of the torque generated by the plying twist.

The spindle design illustrated in FIG. 1 offers the advantage that the yarns are not subjected to the tensions imposed by ballooning by virtue of the support provided to the balloon, or balloons, by the cylinder 5. When producing singles yarn, the yarn 32 is thus subjected only to the centrifugal force developed by the rotation of the relatively short, unsupported length of yarn between the top of the capstan 22 and the yarn ingress point 9, and by the frictional drag on yarn 32 imposed by its passage through the yarn passageways 6 and 7 plus the tension imposed at the capstan 22. When producing two-fold yarns, the yarn 31 is subjected to the forces of frictional drag by passage through the passageways 7 and 6, and the tension imposed by the capstan at its supply package, the yarn 32 is subjected only to the centrifugal force due to rotation of its unsupported length and the tension imposed by the capstan 22, and the two-fold yarn structure 28 is subjected only to the centrifugal forces due to rotation of that relatively short length of yarn between the yarn egress point 8 and the yarn guide 23 plus the tensions existing in the two singles yarns at the yarn egress point 8. The reduced forces thus imposed on a yarn during spinning when the spindle design depicted in FIG. 1 is used make it possible to process at significantly increased spindle speeds and also to manufacture yarn of significantly reduced twist.

It will be evident that, when producing two-fold yarns, it is normally preferred to subject the two singles yarns to equal tensions at the point of, and at the time of, plying. The differing paths followed by the two singles yarns 31 and 32 according to both of the spindle designs shown in FIGS. 1 and 3, can be expected to produce differing tensions in the two singles yarns 31 and 32 at the point of plying. In order to overcome this circumstance it is necessary to provide means for adjusting the overall tension in one or both of the single yarns 31 and 32 during transport from their respective supply packages and the point at which they are converged, i.e., yarn egress point 8. Tension control in the singles yarns is effected according to the present invention by means of an adjustable capstan device around which the yarn is wrapped to provide frictional drag, and incorporated as part of the supports for the two supply packages.

Figure 4:
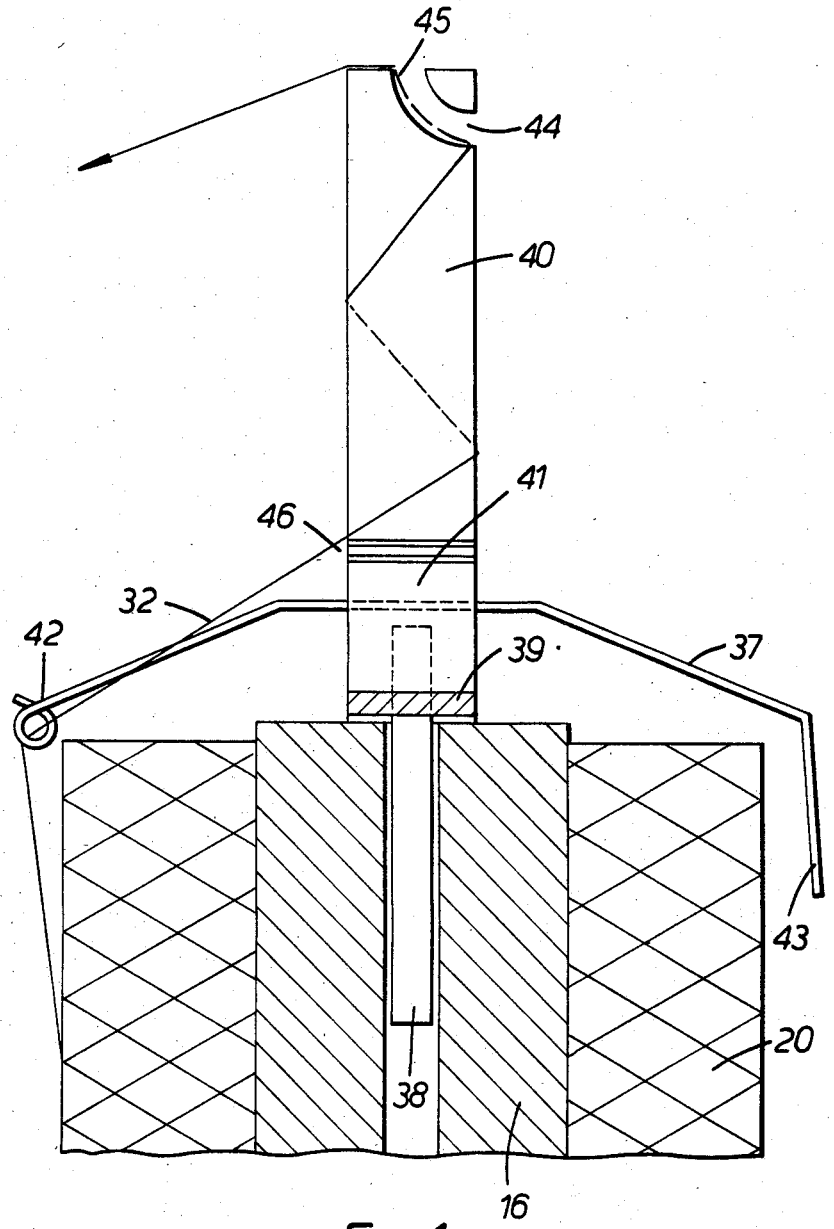
FIG. 4 is a enlarged view of an alternative type of apparatus which can be used for yarn take-off from the supply package, and means of controlling the take-off tension.

FIG. 4 shows an enlarged view of a flyer arm device such as that depicted in FIG. 3. The flyer arm rotates on a shaft 38 which is supported in a bearing 39 fixed in the top of the mandrel 16 carrying the yarn supply package 20. Mounted on, and co-axial with the shaft 38, is a capstan of circular section which is divided into two parts 40 and 41. Fixed to component 41 is the arm of the flyer 37, which has at one end a yarn guide 42 and at its other end a counterbalancing weight 43. The flyer arm 37 is rigidly fixed to the capstan component 41 and rotates with it. The second capstan component 40 has near its top a yarn guide consisting of a yarn ingress 44 in the wall of the capstan which connects with a yarn egress 45 in the top of the capstan and on the axis of rotation of the flyer arm. Yarn 32 from the supply package 20 is delivered via the yarn guide 42 of arm 37 to wrap the capstan component 40 before being threaded through the yarn guide comprising the ingress 44 and the egress 45 in the top of the capstan. Tension is developed in the yarn depending upon the total angle by which it wraps the capstan. The two parts 40 and 41 of the capstan are so constructed and joined together at 46 that component 40 can be rotated relative to component 41, about their common axis, and thus to vary the total angle of wrap of the yarn 32 in a continuous manner. A degree of friction is achieved between the two capstan components 40 and 41 such that their mutually relative positions will not change except by positive adjustment by a deliberate force. By this means the total overall tensions developed in the two singles yarns 31 and 32, can be separately adjusted to achieve equality of singles yarn tension at the point of plying. Further to this, it is also possible to arrange the singles yarns tensions to be unequal when it is required to produce a two-fold or other plied yarns having a fancy spiral effect.

It will be understood that yarns of more complexity than a two-fold structure can be produced if one or both of the supply packages 20 and 25 is replaced by a spun singles yarn embodying real twist, a two-fold yarn, or yarn of other structure. By this means it is possible to build up multiply yarns and cables of any desired construction. For example, if in the first instance a two-fold yarn is produced, starting with two supply packages 20 and 25 comprising singles, twistless yarns, to a linear density of R600/2 tex, and having three twists Z per inch in each ply and three twists S per inch between the two plys, and in the second instance this two-fold yarn is creeled in place of supply package 20 and is further plied with singles twistless yarn of linear density 300 tex from supply package 25, with three twist per inch S, the resulting yarn will be a three-fold construction of linear density R900/3 tex having three twists per inch Z in each of the three component singles yarns, and three twists per inch S plying twist between the three component singles yarns, and three twists per inch S plying twist between the three component singles yarns. If both of the supply packages 11 and 18 are replaced with two-fold yarn of linear density R600/2 tex having three twists per inch Z, in each ply and three twists per inch S between the two plies, and these two, two-fold yarns are then plied together with three twists per inch S then a four-fold yarn of linear density R1200/4 tex is made having three twists per inch Z, in each of the four plies, and three twists per inch S plying twist between the four plies. If, however, these two two-fold yarns are plied together with three twists per inch Z twist, for example, by reversing the direction of rotation of the spindle, then a cabled yarn structure denoted as R1200/2/2 tex is made having three twists per inch Z in each of the four component singles yarns, six twists per inch S plying twist in each of the two two-fold yarns, and three twists per inch Z cabling twist between the two two-fold yarns. Many other yarn structures can be built up in this way as will become evident from further consideration of the multiple twisting and plying actions of the spindle according to the present invention.

It will be appreciated that a raw material supply package of twistless yarn exists and is widely used in the textile industry which is suitable for use in the yarn manufacturing system according to the present invention, this being the slubbing produced by the woollen carding operation. Woollen processed slubbing is prepared on the woollen carding machine in ribbon form, which ribbon is then consolidated by rubbing between reciprocating aprons prior to being wound on the carding machine into spools comprising a multiplicity of cheeses of separate ends of slubbing. These spools are normally creeled complete at a spinning machine such as a ringframe or a mule, but the spool may also be deconsolidated into individual cheeses which are creeled separately at the spinning machine. The conventional cheese of woollen slubbing is a supply package of twistless yarn eminently suitable for use in a spinning machine according to the present invention. In conventional spinning, woollen slubbing is normally subjected to a low draft step of ratio less than 2:1, prior to the insertion of real twist into the yarn, which draft is effected against a false twist as a means of gaining fibre control. The use of a low draft is desirable as a means of improving the yarn evenness and making minor adjustments to the count of the yarn. In the process according to the present invention the drafting step can be effected after the insertion of real twist into the yarn, and to assist this drafting process that real twist may be temporarily modified by the application of a false twist in a manner similar to the conventional process.

In a further known process packages of twistless yarn can be prepared in long draft processes such as the worsted and semi-worsted systems, by means of the continental rubbing finisher, a machine designed primarily for the manufacture of twistless worsted rovings. In this machine worsted tops or slivers are first subjected to draft ratios of up to 30:1 or more in order to attenuate the slivers to a desired linear density, and are then rubbed by reciprocating aprons to consolidate the structure, and are then wound into individual cheeses of twistless roving. It has been found practical by means such as this to provide packages of twistless yarn suitable for the production according to the present invention of many yarn structures.

It will be understood that the foregoing descriptions of preferred embodiments of the present invention, and the operational features and techniques are given by way of example only, and that a number of variations and modifications are possible without departing from the scope and spirit of the appended claims.

What we do claim and desire to obtain by Letters Patent of the United States is:

1. A method of producing in a continuous operation of spun and plied or cabled yarn, the method including the steps of:

supporting a first package of raw material within a balloon in a running yarn;

supporting a second package of raw material spaced from the first package;

withdrawing both ends of the material from their respective packages under controlled and constant low tensions;

guiding and ducting the raw materials from their respective packages to a means for forming a balloon in a running yarn;

simultaneously spinning and plying the running yarns to produce a spun and plied or cabled yarn; and drafting the spun and plied or cabled yarn in a drafting zone with the temporary insertion of false twist before the yarn is delivered to a take-up station.

2. A method as claimed in claim 1 including delivering the spun yarn to a take-up station during which it is drafted in a drafting zone immediately prior ro being wound at the take-up station.

3. A method as claimed in claim 2 which includes temporarily modifying the twist in the yarn within the drafting zone.

4. A method as claimed in claim 1 wherein two-fold yarn is produced in a single stage process.

5. A method as claimed in claim 1 wherein multiply yarns and cables having up to four component strands are produced in a two-stage process.

6. A method as claimed in claim 1 wherein multiply yarns and cables having more than four component strands are produced in a multistage process.

7. A method of producing in a continuous operation a spun singles yarn, the method including the steps of:

supporting a package of raw material within a balloon in a running yarn;

withdrawing the end of the raw material from the package under controlled and constant low tension;

guiding and ducting the raw material from the package to a means for forming the balloon in a running yarn;

spinning by two-for-one twist insertion the raw material to produce a spun singles yarn; and drafting the spun yarn in a drafting zone with the temporary insertion of false twist before the yarn is delivered to a take-up station.

8. A method as claimed in claim 7 including delivering the spun yarn from the drafting zone to a take-up station.

9. A method as claimed in claim 8 which includes temporarily modifying the twist in the yarn within the drafting zone.

10. An apparatus for producing in a continuous operation spun and plied or cabled yarn, the apparatus including:

a rotating member for forming a balloon in a running yarn comprising a hollow spindle having a cylindrical rotor for supporting said balloon;

first and second supports for packages of raw material respectively located within the balloon and outside the balloon;

guides and tensioning devices for withdrawing ends of raw material from the supply packages under controlled and constant low tensions; and further guides and rotating co-operating rollers for effecting delivery, drafting and winding of a yarn from said raw materials.

11. Apparatus as claimed in claim 10 wherein the cylindrical rotor includes a passageway extending therethrough which connects the bore of the spindle with an egress at the top of the rotor, the egress being situated close to an ingress in the rotor wall which also connects to the passageway.

12. An apparatus as claimed in claim 10 wherein the rotating member is a disc mounted on a hollow spindle, the disc being penetrated diametrically by a passageway which interconnects with the bore of the spindle, the disc having an inlet to the passageway which also interconnects with the bore in the spindle.

13. An apparatus as claimed in claim 12 including means for delivering the spun yarn to a take-up station, said means causing the spun yarn to be drafted in a drafting zone.

14. An apparatus as claimed in claim 13 including means for temporarily modifying the twist in the drafting zone.

15. An apparatus as claimed in claim 10 wherein a second cylinder is supported coaxially within the cylindrical rotor and supported on the spindle on a bearing such that the second cylinder can be stationary whilst the spindle and rotor rotate, the second cylinder having close to its upper rim a yarn take-off means.

16. An apparatus as claimed in claim 15 wherein the second cylinder has a central mandrel therewithin which supports on a low friction bearing the support for the first yarn package.

17. An apparatus as claimed in claim 16 wherein said central mandrel has a narrowed portion at the top thereof, and wherein a capstan is mounted on said narrowed portion, said capstan mounting the first yarn guide.

18. An apparatus as claimed in claim 17 wherein a rail supporting the spindle also supports a third stationary guard cylinder which is coaxial with the spindle and second cylinder.

19. An apparatus as claimed in claim 10 wherein a second cylinder is supported coaxially with and on the spindle on a bearing such that the second cylinder can be stationary whilst the spindle rotates, the second cylinder having a central mandrel therewithin which supports on a low friction bearing the support for the first yarn package, the mandrel having a narrowed portion on the top thereof which supports via a bearing a flyer arm coaxially with which is mounted the first yarn guide.

20. An apparatus as claimed in claim 10 in which all twisting functions are carried out simultaneously by a single spindle.

21. An apparatus for producing in a continuous operation a spun singles yarn, the apparatus including:

a support for a package of staple raw material;

a rotating member for forming a balloon in a running yarn;

a means for supporting said balloon so as to reduce to a minimum the tensions and stresses arising in the yarn;

a guide and tensioning device for withdrawing the end of the raw material from the package under controlled and constant low tension; and further guides and rotating co-operating rollers for effecting delivery, drafting and winding of a yarn from said raw material.

22. An apparatus as claimed in claim 21 wherein the cylinder and rotor is penetrated by a passageway which connects the bore of the spindle with an egress at the top of the rotor, the egress being situated close to an ingress in the rotor wall which also connects to the passageway.

23. An apparatus as claimed in claim 21 wherein the rotating member is a disc mounted on a hollow spindle, the disc being penetrated diametrically by a passageway which interconnects with the bore of the spindle, the disc having an inlet to the passageway which also interconnects with the bore in the spindle.

24. An apparatus as claimed in claim 23 including means for delivering the spun yarn to a take-up station, said means causing the spun yarn to be drafted in a drafting zone.

25. An apparatus as claimed in claim 24 including means for temporarily modifying the twist in the drafting zone.

26. An apparatus as claimed in claim 21 wherein a second cylinder is supported coaxially within the cylindrical rotor and supported on the spindle on a bearing such that the second cylinder can be stationary whilst the spindle and rotor rotate, the second cylinder having close to its upper rim the yarn take-off means.

27. An apparatus as claimed in claim 6 wherein the second cylinder has a central mandrel therewithin which supports on a low friction bearing the support for the first yarn package.

28. An apparatus as claimed in claim 27 wherein said central mandrel has a narrowed portion at the top thereof, and wherein a capstan is mounted on said narrowed portion, said capstan mounting the first yarn guide.

29. An apparatus as claimed in claim 28 wherein a rail supporting the spindle also supports a third stationary guard cylinder which is coaxial with the spindle and second cylinder.

30. An apparatus as claimed in claim 21 wherein a second cylinder is supported coaxially with and on the spindle on a bearing such that the second cylinder can be stationary whilst the spindle rotates, the second cylinder having a central mandrel therewithin which supports on a low friction bearing the support for the first yarn package, the mandrel having a narrowed portion on the top thereof which supports via a bearing a flyer arm coaxially with which is mounted the first yarn guide.

* * * * *